United States Patent [19]

Bouchard et al.

[11] 4,229,161

[45] Oct. 21, 1980

[54] PHOTOFLASH LAMP AND METHOD OF MAKING

[75] Inventors: Andre C. Bouchard, Peabody; Lawrence R. Fraley, Ipswich, both of Mass.

[73] Assignee: GTE Products Corporation, Stamford, Conn.

[21] Appl. No.: 33

[22] Filed: Jan. 2, 1979

[51] Int. Cl.[3] ..... F21K 5/02

[52] U.S. Cl. ..... 431/362

[58] Field of Search ..... 431/362, 358

[56] References Cited

U.S. PATENT DOCUMENTS

| | | | |
|---|---|---|---|
| 2,201,294 | 5/1940 | Kreidler | 431/358 |
| 3,228,216 | 1/1966 | Desaulniers et al. | 431/362 |
| 3,602,619 | 8/1971 | Van der Tas et al. | 431/362 |
| 3,884,615 | 5/1975 | Sobieski | 431/362 |
| 3,930,784 | 1/1976 | Anderson | 431/358 |
| 4,082,494 | 4/1978 | Shaffer | 431/362 |

*Primary Examiner*—Carroll B. Dority, Jr.

*Attorney, Agent, or Firm*—Lawrence R. Fraley

[57] ABSTRACT

An electrically-activated photoflash lamp which includes a thin member (e.g. a mica disk) therein located between the lamp's combustible shreds and primer material. The disk prevents the shreds from contacting the primer material and any portions of the lamp's electrical conductors which have access to the interior of the envelope. A method of making the lamp is also provided.

17 Claims, 7 Drawing Figures

PHOTOFLASH LAMP AND METHOD OF MAKING

BACKGROUND OF THE INVENTION

The invention relates to photoflash lamps and particularly to photoflash lamps which are activated electrically.

Such lamps are generally classified into two varieties: low-voltage and high-voltage. Low-voltage photoflash lamps typically include a glass envelope with a combustion-supporting gas (e.g. oxygen) and a quantity of filamentary, combustible material (e.g. shredded zirconium) therein. A pair of electrically conductive lead wires are usually sealed in one end of the envelope and extend therein. A filament is utilized and interconnects the extending ends of the wires. When the filament is heated by a firing current usually generated from a low-voltage source such as a battery or charged capacitor, it ignites a primer material which then ignites the combustible material to produce a flash of light. Naturally, the oxygen gas aids in the above ignition.

In high-voltage lamps, the use of a filament is usually excluded by the provision of a glass or ceramic bead in which are located the extending ends of the lamp's conducting wires. Primer material serves to bridge the portions of these ends which project through the bead. High-voltage lamps also include the aforedescribed filamentary material and combustion-supporting gas. Flashing is accomplished by a firing pulse approaching a few thousand volts and provided by a piezoelectric element. In another type of high-voltage lamp, the primer is located within an indentation in the bottom of the lamp and the conductive wires extend therein.

Understandably, it is highly desirous to prevent shred interference with the lamp's ignition in both of the above types of lamps. This can occur primarily in one of two ways: either by the shreds contacting and shorting the exposed portions of the lead wires within the envelope or by the shreds contacting and lying across the primer material surface.

In both cases, the ignition voltage characteristics are altered, which in some instances can even prevent the lamp from firing. Shred interference can also reduce the firing voltage to the point that ignition is possible electrostatically. In situations wherein the lamp is used in circuitry containing several other lamps (e.g. sequential or random flash embodiments), an altered ignition voltage substantially reduces the lamp's compatibility to the desired circuit.

Various techniques for preventing shred shorting across a pair of exposed lead wires in a photoflash lamp are illustrated in U.S. Pat. Nos. 3,884,615, 3,930,784, and 4,082,494. In 3,884,615, a glass sleeve surrounds one of the lead wires and acts as an insulator therefor. A problem with this technique is that it does not readily lend itself to mass production due to the necessity for precisioned location of the sleeve with respect to the lamp's glass bead component. A problem inherent in the technique disclosed in the remaining patents cited above is the possibility of displacement of the insulative materials during rough handling, shipping, etc. of the lamp. This is particularly true with the lamp described in U.S. Pat. No. 3,930,784 wherein the small glass beads can become intermixed with the filamentary combustible material, especially during handling wherein the lamp is inverted. Another disadvantage of the lamp of U.S. Pat. No. 3,930,784 is that such relatively large quantities of beads as required occupy portions of the lamp normally reserved for the essential, combustion-supporting atmosphere. The potentially adverse results of such a requirement are self-explanatory.

All of the above patents also fail to recognize the problems caused by shred interaction with the surface of the desired primer material. One method of attempting to solve this is shown in U.S. Pat. No. 3,602,619, wherein a hollow glass tube surrounds the mass of primer material and extends thereabove. The portions of the lead wires which were exposed in the earlier mentioned patents are embedded within the lamp envelope's seal (or bottom) portion. A problem inherent in U.S. Pat. No. 3,602,619 is that the lamp's filamentary shreds can still settle within the open tube as a result of rough handling of the lamp. Still further, the lamp does not lend itself to known techniques of mass production due to the extreme difficulty of positioning the glass tube at the location required.

It is believed, therefore, that a photoflash lamp which is capable of facilely preventing shred interference between the lamp's combustible filaments and both the lamp's primer material and any portion of the lamp's conductive wires which are exposed within the envelope would constitute an advancement in the art.

It is also believed that a method of making a lamp having the above unique capability would constitute an art advancement.

OBJECTS AND SUMMARY OF THE INVENTION

It is, therefore, a primary object of the present invention to enhance the photoflash lamp art by providing a lamp which substantially eliminates both of the troublesome problems of shred interference with the lamp's primer material and any exposed portions of the conductive wires within the lamp's envelope.

It is a particular object of the invention to accomplish the above while still providing a photoflash lamp which is adapted to automated assembly and eliminates the need for relatively expensive lamp components such as glass beads or sleeves.

Still another object of the invention is to provide a method for making the above lamp.

These and other objects, advantages, and features are attained in accordance with the principles of this invention by providing an electrically-activated photoflash lamp which includes a light-transmitting envelope containing a combustion-supporting gas and a quantity of filamentary combustible material therein. The lamp further includes an ignition means for igniting the combustible material, this means comprising a pair of spaced-apart conductors and a mass of prime material in contact with the ends of said conductors. To prevent shred contact with the conductors and the primer, a thin member is positioned within the envelope between the lamp's combustible shreds and the primer and conductor ends.

In accordance with another principle of the invention, a method is provided for making a photoflash lamp. The method involves sealing a pair of spaced-apart conductors within a first end of a tubular, light-transmitting member, positioning a mass of primer material in contact with the ends of the conductors which have access to the interior of the tubular member, and then introducing a thin member through an opposing open end of the tubular member. A quantity of filamentary combustible material (shreds) is then added in addition to a combustion-supporting atmosphere after which the opposing second end of the tubular member is sealed, defining an envelope. The thin member is located between the shreds and the primer and conductor ends to prevent shred contact therewith.

DETAILED DESCRIPTION OF THE PREFERRED EMBODIMENTS

For a better understanding of the present invention together with other and further objects, advantages and capabilities thereof, reference is made to the following disclosure and appended claims in connection with the above described drawings.

Figure 1:
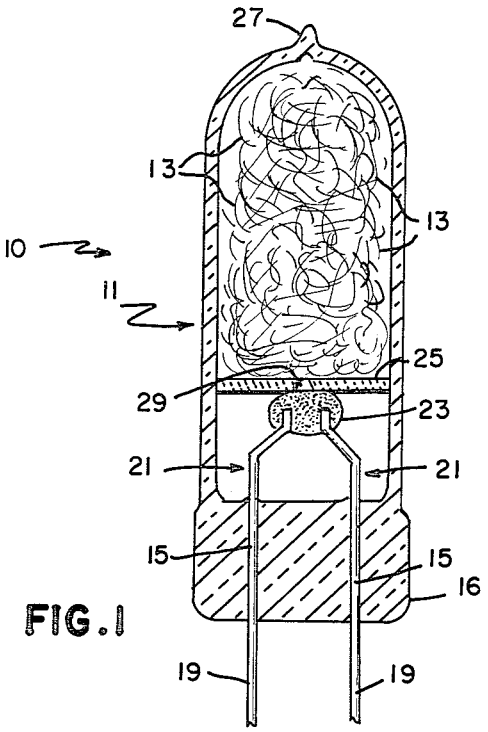
FIG. 1 is an elevational view, in section, of a photoflash lamp in accordance with a preferred embodiment of the invention.

With particular reference to FIG. 1, there is illustrated a photoflash lamp 10 which comprises a hermetically-sealed, light-transmitting envelope 11 having a combustion-supporting atmosphere and a quantity of combustible filamentary material 13 therein. Envelope 11 is manufactured from a tubular glass (e.g. borosilicate) member having opposing open ends. A pair of spaced-apart electrical conductors 15 are press-sealed within one of the ends (16) such that portions 19 of these conductors project externally therefrom. Conductors 15 also include end portions 21 which have access to the interior of envelope 11 such that a mass of primer material 23 may be placed in electrical contact therewith. Understandably, conductors 15 and primer 23 comprise the means for igniting combustible material 13 when an electrical pulse is applied thereto.

Figure 2:
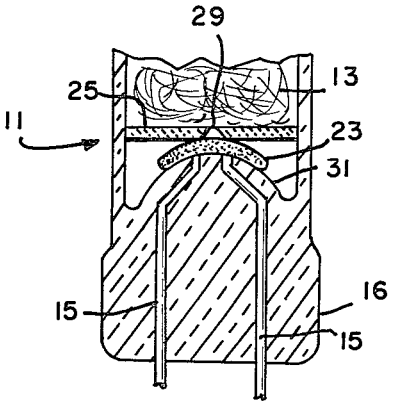
FIGS. 2 and 3 are partial elevational views, in section, of various alternative embodiments of photoflash lamps of the invention.

The pulse is preferably supplied by a piezoelectric element (not shown) located externally of lamp 10. Application thereof across conductors 15 results in intense deflagration of primer 23, which in turn ignites the lamp's main charge (combustible material 13). By access is meant that end portions 21 either project within envelope 11 (as shown in FIG. 1) or lie approximately flush with an interior wall of the envelope (as shown in FIG. 2). In either case, the conductive primer material 23 effects contact with these portions so as to provide an electrical "bridge" thereacross.

As stated, envelope 11 is glass. The preferred primer material 23 is a composition of approximately 85 percent zirconium, 13 percent potassium chlorate, and 2 percent nitrocellulose. One method of applying primer 23 is by the conventional dip process followed by a drying step (e.g. 100° C. for 15 minutes). In the embodiment illustrated in FIG. 1, it is possible to also utilize a glass or ceramic bead which encompasses the extreme ends of conductors 15 and contains the requisite primer 23 thereon. Such a member also lends stability to this portion of the lamp's ignition means, in addition to assuring that end portions 21 maintain the desired spacing therebetween. Conductors 15 are preferably 0.014 inch diameter wires comprised of a nickel-iron alloy and are located about 0.030 inch apart. The preferred combustible material 13 is approximately 14 milligrams of shredded zirconium (or hafnium) while the preferred supporting atmosphere is oxygen. Typically, the oxygen is established at a pressure of several atmospheres.

To prevent shreds 13 from contacting and shorting across the exposed end portions 21, in addition to assuring that these shreds will not engage the external surface of conductive primer 23, a thin member 25 is positioned within envelope 11 between the shreds and said components. Thin member 25 is preferably a cylindrical disk of electrically insulative material and, in the embodiment of FIG. 1, is positioned in contact with primer 23. Member 23 is preferably comprised of mica and has a thickness within the range of about 0.001 inch to about 0.0015 inch. Understandably, the extremely small volume of member 25 assures that this member will not occupy interior portions of envelope 11 normally reserved for the requisite quantity of oxygen gas. It is thus possible to produce lamp 10 in accordance with the principles of miniaturization demanded in the photoflash lamp industry. Despite the relative thinness of member 25, the member is still able to maintain sufficient rigidity such that it will not bend or become similarly deformed during rough handling of lamp 10. It is for this particular reason that a material such as mica was selected. In addition, mica will not adversely react with the internal elements of the lamp, including the preferred combustion-supporting atmosphere. It is also understandable that rigidity enhances mass production of lamp 10 by facilitating positioning of member 25 therein.

In FIG. 1, member 25 is held in contact with primer 23 by shreds 13. As will be defined, this member may also be functionally located within envelope 11 such that the member is spacedly located from the lamp's primer. Contact therewith is, of course, also possible with this means of retention. Envelope 11 has an internal volume of less than one cubic centimeter and an internal diameter of 0.230 inch. Accordingly, cylindrical disk member 25 of FIG. 1 preferably has an external diameter of 0.224 inch to thereby assure an accommodating fit within envelope 11 in such a manner that shreds 13 cannot enter the open region below the member.

Subsequent to positioning of the aforementioned elements in the respective locations shown, the opposing end (27) of the glass tubing is sealed to define the ultimate configuration for envelope 11. The preferred method for effecting this seal involves a tipping operation well known in the photoflash lamp art. It is understood from the foregoing that primer material 23, disk member 25, shreds 13, and the combustion-supporting atmosphere enter the glass tubing through the opposing end 27 prior to sealing thereof. It is further understood that conductive wires 15 have already been firmly secured within the first, press-sealed end 16 prior to the above positioning.

With added regard to FIG. 1, mica disk member 25 includes a small opening 29 therein for controlling the upward direction of deflagration of primer 23. Opening 29 is stamped within the disk during manufacture thereof, and has a diameter of 0.007. Although only one opening 29 is illustrated, it is understood that several smaller openings could be utilized instead, provided such openings are capable of assuring the defined directional control. Opening 29 is located immediately adjacent primer 23.

In the embodiment of FIG. 2, the first sealed end 16 of envelope 11 is formed such that the extreme ends of conductor 15 lie approximately flush with the bottom interior wall 31 of envelope 11. In producing this lamp, conductors 15 were originally positioned to extend within envelope 11 during the sealing of end 16. Subsequent thereto, the extending end portions were etched away by a warm 50/50 hydrochloric/nitric acid solution. The lamp "bottle" was then thoroughly washed out with water, drained, and dried for about 30 minutes in a forced hot air oven at 100° C. Application of primer 23 is achieved by dipping the ends of a 0.060 steel rod into a slurry of primer and thereafter inserting the rod through the opposing, open end of the glass tubing. After placement of the wet primer in the location shown, the rod is withdrawn and the primer, constituting approximately 10 microliters in volume, is dried by placing the bottle in an oven for 15 minutes at 100° C. Disk 25, shreds 13, and the oxygen gas are then introduced after which the envelope is tipped off in the manner similar to that described for lamp 10 in FIG. 1.

Figure 3:
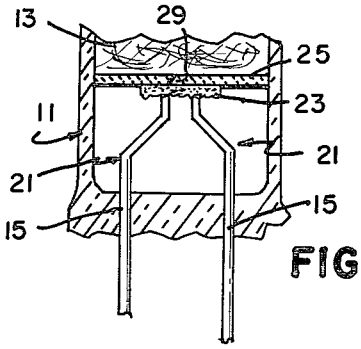

In FIG. 3, conductors 15 include exposed end portions 21 similar to those in FIG. 1 In this embodiment, however, the desired primer material is applied to disk 25 prior to insertion thereof within envelope 11 and contact with end portions 21. Primer 23 may be in slurry form or dried prior to effecting said contact. Shreds 13 and the oxygen gas are then added.

Figure 4:
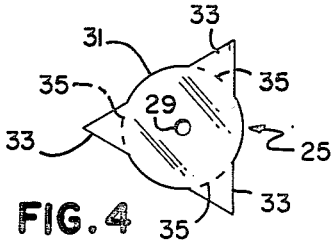
FIG. 4 is a plan view of a thin member for preventing shred interference in accordance with one embodiment of the invention.
Figure 5:
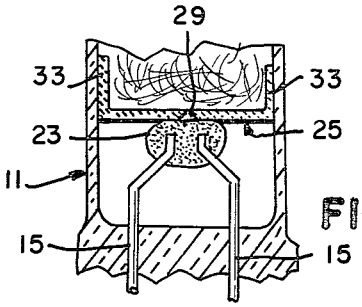
FIG. 5 is a partial elevational view, in section, of a photoflash lamp utilizing the thin member of FIG. 4.

In FIG. 4, there is shown an alternate embodiment of a thin member 25 suitable for use in the present invention. Member 25 includes a substantially cylindrical body portion 31, an opening 29 located approximately in the center of body portion 31, and at least two tabs 33 which project from the body portion. The preferred number of tabs 33 is three, each offset about 120° on cylindrical body 31. Member 25 is preferably of the same thickness as member 25 in FIG. 1. When positioned within a suitable envelope 11, as shown in FIG. 5, tabs 33 frictionally engage the interior walls of the envelope to assist in securedly positioning member 25 at the desired location. Accordingly, tabs 33 are each bent at fold lines 35 when member 25 is in its final position.

Figure 7:
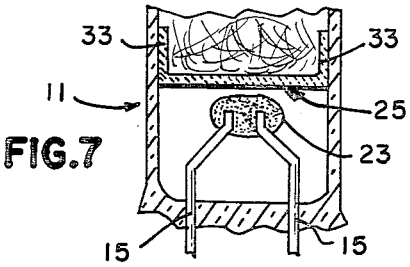
FIG. 7 is a partial elevational view, in section, of a photoflash lamp utilizing the thin member of FIG. 6.
Figure 6:
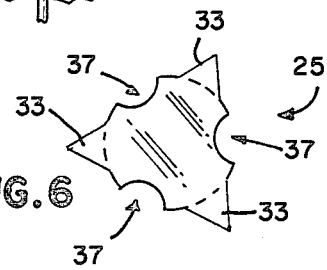
FIG. 6 is a plan view of a thin member in accordance with another embodiment of the invention.

The thin member 25 of FIG. 6 is substantially similar to that of FIG. 4 with the exception that no central opening is provided. Instead, a plurality (e.g. three) of recesses 37 are provided at spaced locations within the periphery of the member's cylindrical body portion. Recesses 37 provide the necessary directional control for the deflagrating primer 23. The thin member of FIG. 6 is shown in position within an envelope in FIG. 7. As illustrated therein, member 25 is capable of being spacedly located from the respective mass of primer 23 by virtue of the frictional retention provided by tabs 33. It is understood that member 25 of FIG. 6 needs only one recess 37 therein. Three recesses are preferred, however, with all of these equally spaced about the member's body portion (e.g. at 120° intervals). It is also possible to spacedly locate the thin member of FIG. 4 from the respective primer 23.

Thus there has been shown and described a photoflash lamp which represents a substantial improvement over lamps of the prior art. A method of making this lamp has also been described. Although the lamp represented in the drawings is of the high voltage variety, it is understood that the teachings of the invention also extend to low voltage lamps. For example, disk member 25 could be located atop a pair of exposed conductors which have a thin filament connected thereacross. The desired primer for this lamp would be located on the filament as is typical in low voltage flashlamps. Ignition of the primer would result in deflagration thereof up through the provided aperture(s) or recess(s) within the disk.

While there have been shown and described what are at present considered the preferred embodiments of the invention, it will be obvious to those skilled in the art that various changes and modifications may be made therein within departing from the scope of the invention as defined by the appended claims.

What is claimed is:

1. A photoflash lamp comprising:

a hermetically-sealed, light-transmitting envelope including a combustion-supporting atmosphere therein;

a quantity of filamentary combustible material located within said envelope;

ignition means for igniting said combustible material, said ignition means including a pair of electrical conductors sealed within said envelope and projecting therefrom, each of said conductors including an end portion having access to the interior of said envelope, and a mass of primer material located within said envelope in electrical contact with said end portions of said electrical conductors; and a thin member positioned within said envelope and dividing said envelope into first and second portions, said first portion containing said combustible material and said second portion containing said end portions of said electrical conductors and said primer material and being void of filamentary combustible material, said thin member preventing said combustible material from electrically contacting said end portions and said primer material; means forming a passage between said first and second portions of said envelope for ignition of said filamentary material by said primer material.

2. The photoflash lamp according to claim 1 wherein said thin member is electrically insulative.

3. The photoflash lamp according to claim 2 wherein said thin member is positioned in contact with said primer material.

4. The photoflash lamp according to claim 3 wherein said thin member includes an opening therein, said opening located immediately adjacent said primer material.

5. The photoflash lamp according to claim 3 wherein said thin member includes at least one recess located within the periphery thereof.

6. The photoflash lamp according to claim 3 wherein said thin member include at least two projecting tabs, said tabs frictionally engaging the internal walls of said envelope.

7. The photoflash lamp according to claim 2 wherein said thin member is spacedly positioned from said primer material, said thin member including at least two projecting tabs, said tabs frictionally engaging the internal walls of said envelope.

8. The photoflash lamp according to claim 7 wherein said thin member includes an opening therein, said opening located substantially within the center of said thin member.

9. The photoflash lamp according to claim 7 wherein said thin member includes at least one recess located within the periphery thereof.

10. The photoflash lamp according to claim 2 wherein said primer material is located on said thin member.

11. The photoflash lamp according to claim 2 wherein said thin member is a substantially cylindrical disk.

12. The photoflash lamp according to claim 2 wherein said thin member is comprised of mica.

13. A method of making a photoflash lamp, said method comprising:

providing a tubular, light-transmitting member having first and second open ends;

positioning a pair of spaced-apart electrical conductors within a first of said open ends;

hermetically sealing said first open end to include said conductors therein such that each of said conductors project therefrom and include an end portion having acess to the interior of said tubular member;

positioning a mass of primer material in electrical contact with said end portions of said conductors through said second open end;

locating a thin member within said tubular, light-transmitting member through said second open end to divide said light transmitting member into first and second portions;

positioning a quantity of filamentary combustible material within said first portion of said tubular, light-transmitting member through said second open end;

introducing a combustion-supporting atmosphere within said tubular, light-transmitting member through said second open end; and sealing said second end to define a hermetically-sealed envelope, said thin member positioned within said envelope between said filamentary, combustible material and said end portions of said electrical conductors and said primer material to prevent said combustible material from electrically contacting said end portions and said primer material, said second portion of said envelope being void of filamentary combustible material; and providing passage means between the first and second portions for ignition of said filamentary material by said primer material.

14. The method according to claim 13 wherein said primer material is positioned within said tubular member in slurry form.

15. The method according to claim 13 wherein said end portions of said electrical conductors extend within said tubular member after said sealing of said conductors within said first end, said method further including removing said extending end portions prior to said positioning of said primer material.

16. The method according to claim 15 wherein said removing of said extending end portions is accomplished by etching.

17. The method according to claim 13 wherein said mass of primer material is positioned on said thin member prior to locating said thin member within said tubular light-transmitting member.

* * * * *